US009909830B1

(12) United States Patent
Toole et al.

(10) Patent No.: US 9,909,830 B1
(45) Date of Patent: Mar. 6, 2018

(54) MODULAR FIREARM GRIP COVER ASSEMBLY WITH SIGHTING DEVICE

(71) Applicant: Lumen Defense Products Inc, Oregon City, OR (US)

(72) Inventors: Robert Mark Toole, Portland, OR (US); Gregory Ross Andren, West Linn, OR (US)

(73) Assignee: Lumen Defense Products Inc, Oregon City, OR (US)

( * ) Notice: Subject to any disclaimer, the term of this patent is extended or adjusted under 35 U.S.C. 154(b) by 0 days.

(21) Appl. No.: 15/413,168

(22) Filed: Jan. 23, 2017

(51) Int. Cl.

| | |
|---|---|
| ***F41G 1/32*** | (2006.01) |
| ***F41C 23/10*** | (2006.01) |
| ***F41A 35/02*** | (2006.01) |
| ***F41G 1/35*** | (2006.01) |

(52) U.S. Cl.
CPC ..... *F41A 35/02* (2013.01); *F41G 1/35* (2013.01)

(58) Field of Classification Search
CPC ..... F41G 1/30; F41G 1/32; F41G 1/34; F41C 23/10; F41C 23/16
USPC ..... 42/114, 115, 71.01; D22/100, 104, 108, D22/109, 111
See application file for complete search history.

(56) References Cited

U.S. PATENT DOCUMENTS

| | | | | |
|---|---|---|---|---|
| 4,043,066 | A * | 8/1977 | Pachmayr | F41C 23/10 42/71.02 |
| D257,166 | S | 9/1980 | Hogue | |
| 4,286,401 | A * | 9/1981 | Pachmayr | F41C 23/10 42/71.02 |
| 5,179,235 | A | 1/1993 | Toole | |
| 5,231,237 | A * | 7/1993 | Cupp | F41C 23/10 42/71.02 |
| D349,938 | S | 8/1994 | Hogue et al. | |
| 5,435,091 | A | 7/1995 | Toole et al. | |
| 5,621,997 | A * | 4/1997 | Pearce | F41C 23/10 42/7 |
| 5,706,600 | A | 1/1998 | Toole et al. | |
| 6,073,381 | A * | 6/2000 | Farrar | F41C 23/10 42/71.02 |
| 7,260,910 | B2 | 8/2007 | Danielson | |
| 7,472,830 | B2 | 1/2009 | Danielson | |
| 7,805,876 | B1 | 10/2010 | Danielson et al. | |
| 8,181,378 | B2 * | 5/2012 | Losinger | F41C 23/10 42/71.02 |
| 8,256,154 | B2 | 9/2012 | Danielson et al. | |
| D669,552 | S | 10/2012 | Essig et al. | |
| D669,957 | S * | 10/2012 | Hughes | D22/108 |
| D676,097 | S * | 2/2013 | Izumi | D22/109 |
| D689,162 | S | 9/2013 | Hilbourne et al. | |
| 8,662,694 | B1 * | 3/2014 | Izumi | F41G 1/34 362/109 |
| 8,746,221 | B2 * | 6/2014 | Rentz | F41B 5/1469 124/1 |

(Continued)

*Primary Examiner* — Derrick R Morgan
(74) *Attorney, Agent, or Firm* — Kolisch Hartwell, P.C.

(57) ABSTRACT

A grip cover assembly for a handgrip of a firearm may include modular side panels joined by a resilient finger bridge. Openings may be formed between the finger bridge and the side panels to expose a portion of the underlying handgrip surface. A laser sighting device may be housed in one of the side panels, with an adjustable laser emitter having a substantially vertical orientation. A laser beam emitted by the laser emitter may be redirected to a substantially horizontal beam path by a reflector, also housed in the side panel.

20 Claims, 9 Drawing Sheets

(56) References Cited

U.S. PATENT DOCUMENTS

| | | | | |
|---|---|---|---|---|
| D709,585 | S | 7/2014 | Klecker et al. | |
| 8,807,779 | B1 | 8/2014 | Izumi et al. | |
| D738,987 | S | 9/2015 | Hughes | |
| 9,134,094 | B2 | 9/2015 | Hilbourne et al. | |
| 9,243,865 | B1 | 1/2016 | Bruhns | |
| D755,341 | S | 5/2016 | Hartley | |
| D763,398 | S * | 8/2016 | Anderson | D22/109 |
| 2008/0105246 | A1* | 5/2008 | Marques | F41B 11/62 124/80 |
| 2011/0289812 | A1* | 12/2011 | Losinger | F41C 23/10 42/72 |
| 2013/0047379 | A1* | 2/2013 | Zilke | F41B 5/148 16/421 |
| 2014/0082983 | A1* | 3/2014 | Ermossa | F41C 23/10 42/69.01 |
| 2015/0308670 | A1* | 10/2015 | Moore | F21V 23/04 362/114 |

* cited by examiner

MODULAR FIREARM GRIP COVER ASSEMBLY WITH SIGHTING DEVICE

INTRODUCTION

The popularity and usefulness of laser sighting devices integrated into firearm handgrips have grown over the past several years. Components of known laser grips are often essentially inseparable, having been manufactured using overmolding processes and the like. This causes later steps, such as painting of the assembly, to be cumbersome and costly, because certain more fragile components must be masked or otherwise protected. Certain appearance-modifying methods may be completely prohibited. In addition, known grips typically locate and orient a laser emitter and related systems, such that the laser interferes with a user's grip. Finally, it is also growing fashionable for users to customize the appearance of their firearms using methods such as ceramic coating. Known add-on grip assemblies can be undesirable in this context, as the grip assemblies completely cover a handgrip surface of the firearm. Accordingly, a need exists for a laser grip cover assembly that is efficient to manufacture and modify, and that shows and/or enhances the underlying surface of a host firearm.

SUMMARY

Various embodiments of the grip cover assemblies described in the present teachings overcome the issues described above, for example by including an adjustable, vertically-oriented laser assembly, by modular manufacturing methods, and/or by including grip components that naturally form openings in the grip assembly to expose the underlying host device, among other possibilities.

In some embodiments, a grip cover assembly for a firearm may include: a first grip cover attachable to a first side of a handgrip of a firearm, a first front edge portion of the first grip cover configured to be adjacent a front of the handgrip when the first grip cover is attached to the handgrip; a second grip cover attachable to a second side of the handgrip, the second grip cover housing a laser assembly configured to selectively project a laser beam through a laser aperture in the second grip cover, a second front edge portion of the second grip cover configured to be adjacent the front of the handgrip when the second grip cover is attached to the handgrip; and a bridge portion coupling the first front edge portion to the second front edge portion and configured to wrap around the front of the handgrip, the bridge portion including a central spine portion having a first plurality of spaced-apart appendages extending from a first lateral side of the central spine portion to mate with the first front edge portion of the first grip cover, and a second plurality of spaced-apart appendages extending from a second lateral side of the central spine portion to mate with the second front edge portion of the second grip cover; wherein one or more first openings are formed between the central spine portion of the bridge portion and the first front edge portion of the first grip cover, and one or more second openings are formed between the central spine portion of the bridge portion and the second front edge portion of the second grip cover, such that the first and second openings are configured to expose the handgrip of the firearm.

In some embodiments, a laser grip cover may include: a monolithic first grip cover panel including a first front edge portion having a plurality of first tab receptacles formed therein; a monolithic second grip cover panel including a first cavity housing a substantially vertical laser emitter and a reflector disposed at an emitter end of the laser emitter, the first cavity disposed in a top end portion of the second grip cover panel, and a second front edge portion having a plurality of second tab receptacles formed therein; and a bridge portion having a plurality of first tabs mated with respective ones of the first tab receptacles and a plurality of second tabs mated with respective ones of the second tab receptacles, coupling the first front edge portion of the first grip cover panel to the second front edge portion of the second grip cover panel, and forming a plurality of first openings between the bridge portion and the first front edge portion and a plurality of second openings between the bridge portion and the second front edge portion.

In some examples, a method of manufacturing a grip cover assembly for a firearm may include: producing a first grip cover including a monolithic first body configured to conform to a first lateral face of a handgrip of a host device, the first body further comprising an undulating first front edge portion including a first inner face having a plurality of first receptacles formed therein; producing a second grip cover including a monolithic second body configured to conform to a second lateral face of the handgrip of the host device, the second body further comprising one or more cavities configured to house a laser assembly, and an undulating second front edge portion including a second inner face having a plurality of second receptacles formed therein; producing a bridge portion comprising a central spine portion having a plurality of first appendages extending from a first lateral side of the spine portion and a plurality of second appendages extending from a second lateral side of the spine portion, the bridge portion comprising a resilient material; attaching the bridge portion to the first grip cover by mating each of the first appendages of the bridge portion to a respective one of the first receptacles of the first grip cover; and attaching the bridge portion to the second grip cover by mating each of the second appendages of the bridge portion to a respective one of the second receptacles of the second grip cover; wherein one or more first openings are formed between the central spine portion of the bridge portion and the first front edge portion of the first grip cover, and one or more second openings are formed between the central spine portion of the bridge portion and the second front edge portion of the second grip cover.

Features, functions, and advantages may be achieved independently in various embodiments of the present disclosure, or may be combined in yet other embodiments, further details of which can be seen with reference to the following description and drawings.

DESCRIPTION

Figure 1:
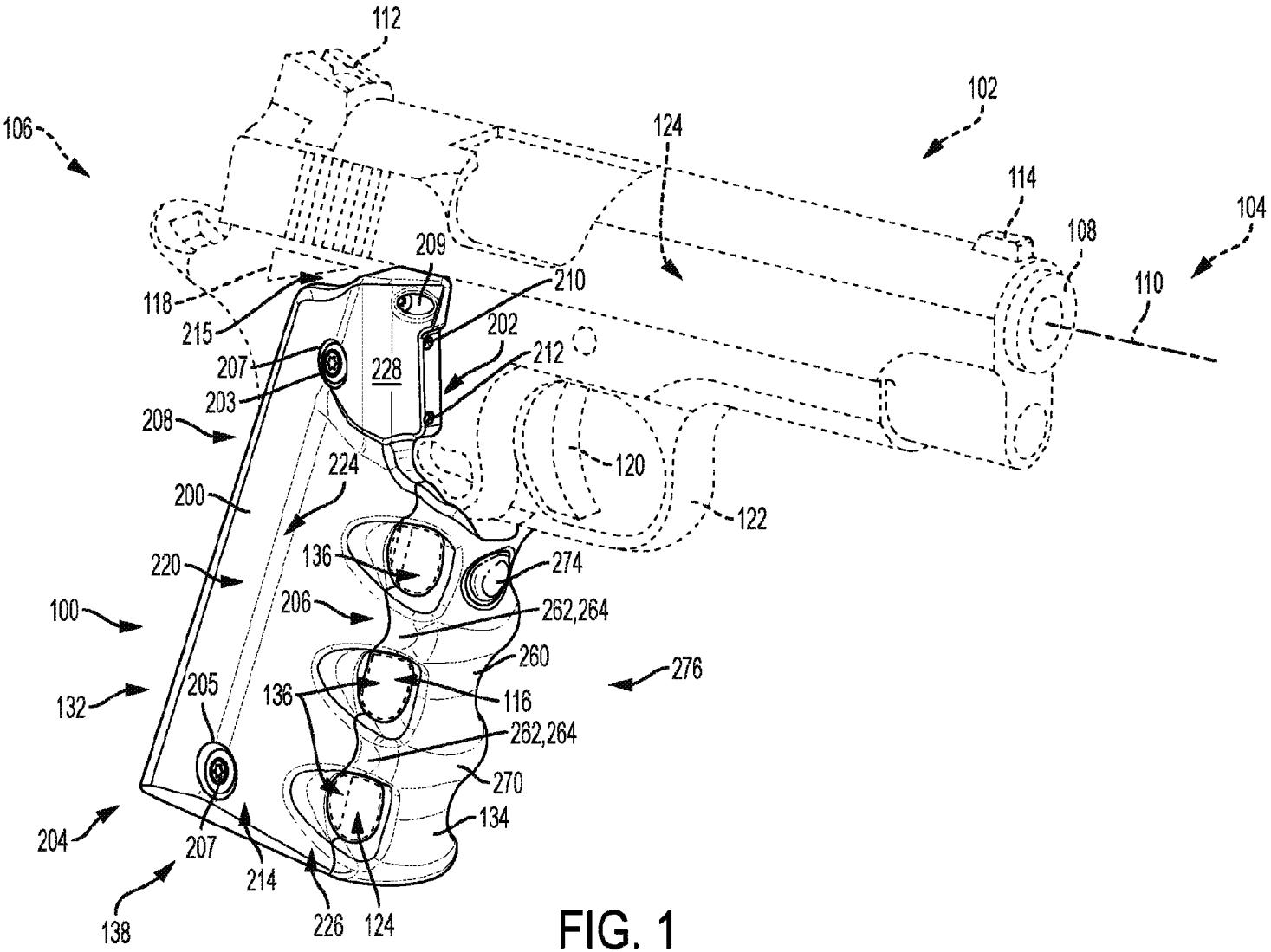
FIG. 1 is an oblique front isometric view of an illustrative grip cover assembly according to the present teachings, mounted on an illustrative handgun.

Various aspects and examples of a modular firearm grip cover assembly having an integrated laser sighting device, as well as related methods, are described below and illustrated in the associated drawings. Unless otherwise specified, a modular firearm grip cover assembly according to the present teachings, and/or its various components, may, but are not required to, contain at least one of the structure, components, functionality, and/or variations described, illustrated, and/or incorporated herein. Furthermore, unless specifically excluded, the process steps, structures, components, functionalities, and/or variations described, illustrated, and/or incorporated herein in connection with the present teachings may be included in other similar devices and methods, including being interchangeable between disclosed embodiments. The following description of various examples is merely illustrative in nature and is in no way intended to limit the disclosure, its application, or uses. Additionally, the advantages provided by the examples and embodiments described below are illustrative in nature and not all examples and embodiments provide the same advantages or the same degree of advantages.

Definitions

The following definitions apply herein, unless otherwise indicated.

"Substantially" means to be essentially conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional, unrecited elements or method steps.

Terms such as "first", "second", and "third" are used to distinguish or identify various members of a group, or the like, and are not intended to show serial or numerical limitation.

Directional terms such as "up," "down," "rear," "forward," "vertical," "horizontal," and the like are intended to be understood in the context of a host firearm on which systems described herein may be mounted or otherwise attached. If applicable, the host firearm should be considered as it is held in a typical firing position, such that the barrel of the weapon is substantially horizontal. In the absence of a host firearm, the same directional terms may be used as if the firearm were present. For example, even when viewed in isolation, a component may have a "forward" edge, based on the fact that the edge in question would be installed generally facing the front portion (i.e., muzzle end) of a host firearm.

Overview

In general, a modular firearm grip cover assembly according to the present teachings may include a pair of grip covers or panels, each of which is configured to be attached to a lateral side or face of a handgun grip, and a bridge portion configured to bridge the forward edges of the grip covers, wrapping around a front of the handgun grip, and provide an ergonomic finger grip for the user. A laser assembly is housed in one of the two grip covers, such that the laser can be selectively activated (e.g., by a pushbutton in the bridge) to produce a laser beam substantially aligned with the barrel of the handgun. This beam can be used to illuminate a target and adjusted to accurately indicate the likely impact point of a projectile fired by the handgun. A laser of the laser assembly may be oriented vertically, with the laser beam being redirected along the sighting axis (i.e., horizontally) by a reflector (e.g., a prism) contained within the grip cover, before exiting to illuminate the target. This orientation fits the laser compartment into a natural crook of the user's trigger finger, and makes it possible to narrow the upper portion of the grip cover, thereby facilitating greater customization of grip cover shape and making room for adjacent firearm components, such as safety levers.

Due to their modular nature, the grip covers and bridge portion may be manufactured separately, e.g., using different materials, and then assembled. This facilitates further processing of each piece without affecting the remaining pieces of the assembly. For example, each grip cover may have its surface appearance altered, such as by adding indicia, by painting, or by water transfer printing (i.e., hydrographics), without the need for time-consuming masking, cleaning, and touch-up processes.

Furthermore, the grip covers and bridge may be shaped such that relatively large openings are formed near the front of the grip. The modular nature of the components facilitates the natural formation of these openings without cutting or punching any holes. The openings may be desirable for several reasons, such as to provide comfortable and ergonomic seats for the user's fingers and to reveal the underlying surface of the handgun grip. Users frequently alter the surface of their handguns to create a distinct look, such as by adding a colored ceramic coating to the weapon. Openings in the grip cover assembly permit such an underlying coating to be revealed in an aesthetically pleasing fashion.

Although weapons and firearms (e.g., pistols and handguns) are referenced for efficiency of explanation throughout this disclosure, grip cover assemblies according to the present teachings may be used with any suitable device that has a handgrip and that may benefit from a laser sight (e.g., air guns, paintball guns, BB guns, pellet guns, rifles and machine guns having pistol grips, slingshots, tools such as infrared thermometers and long-range microphones, aimable optical devices such as telescopes, and the like).

EXAMPLES, COMPONENTS, AND ALTERNATIVES

The following sections describe selected aspects of exemplary grip cover assemblies, as well as related systems and/or methods. The examples in these sections are intended for illustration and should not be interpreted as limiting the entire scope of the present disclosure. Each section may include one or more distinct embodiments or examples, and/or contextual or related information, function, and/or structure.

Illustrative Handgun Grip Cover Assembly

As shown in FIGS. 1-10, this section describes an illustrative grip cover assembly 100 having a laser sight system, referred to as a laser assembly 300. Assembly 100 and laser assembly 300 are examples of the corresponding elements described in the Overview above.

Figure 2:
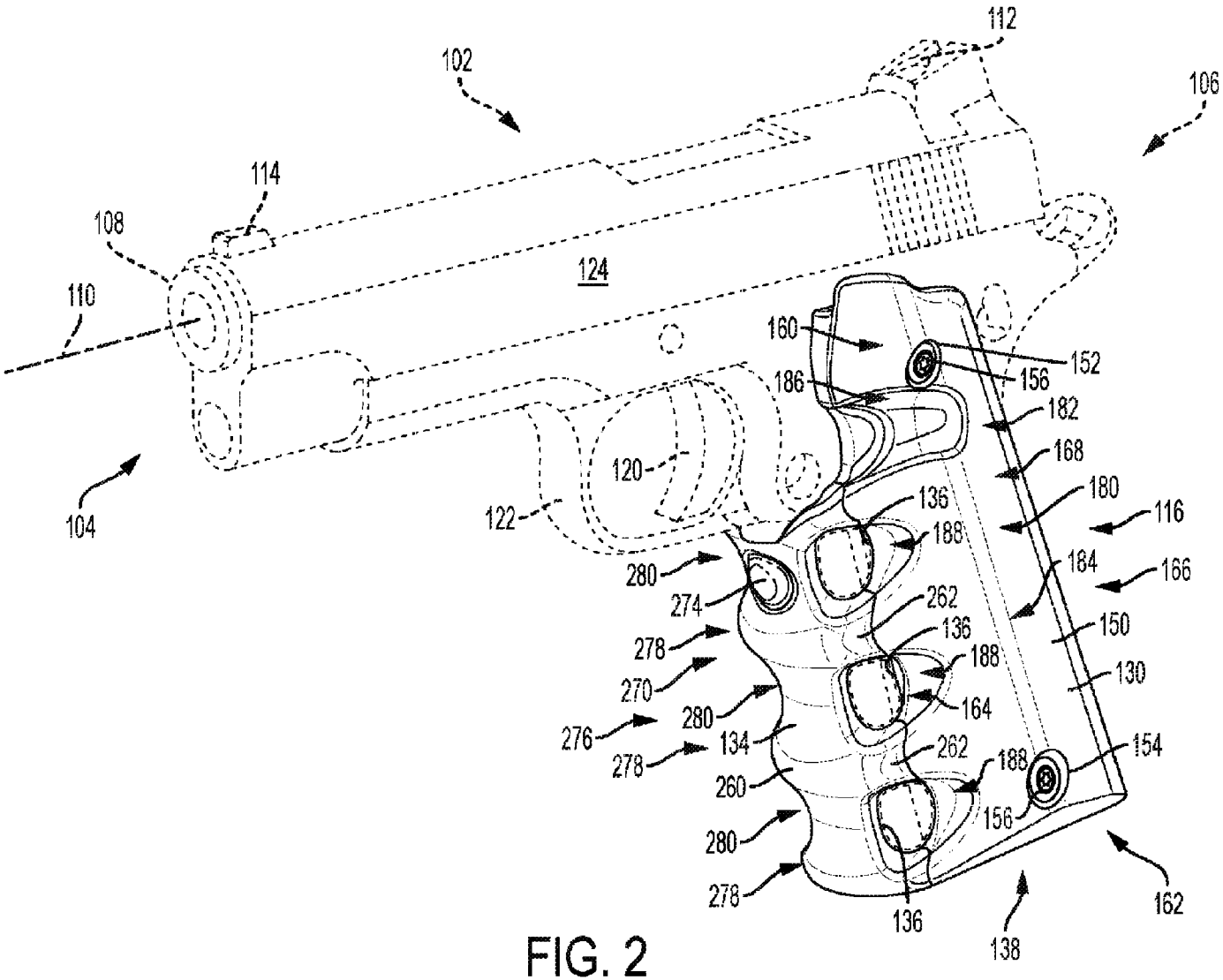
FIG. 2 is an oblique front isometric view of the grip cover assembly and handgun of FIG. 1, from an opposing viewpoint.
Figure 4:
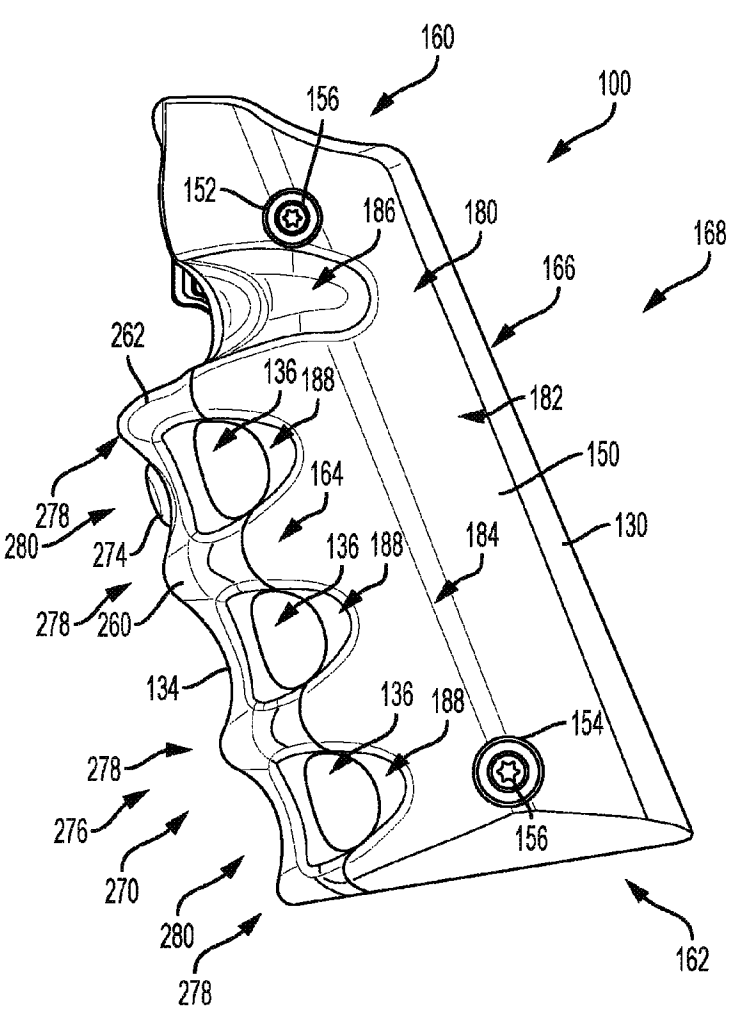
FIG. 4 is a left side elevation view of the grip cover assembly of FIG. 1.
Figure 3:
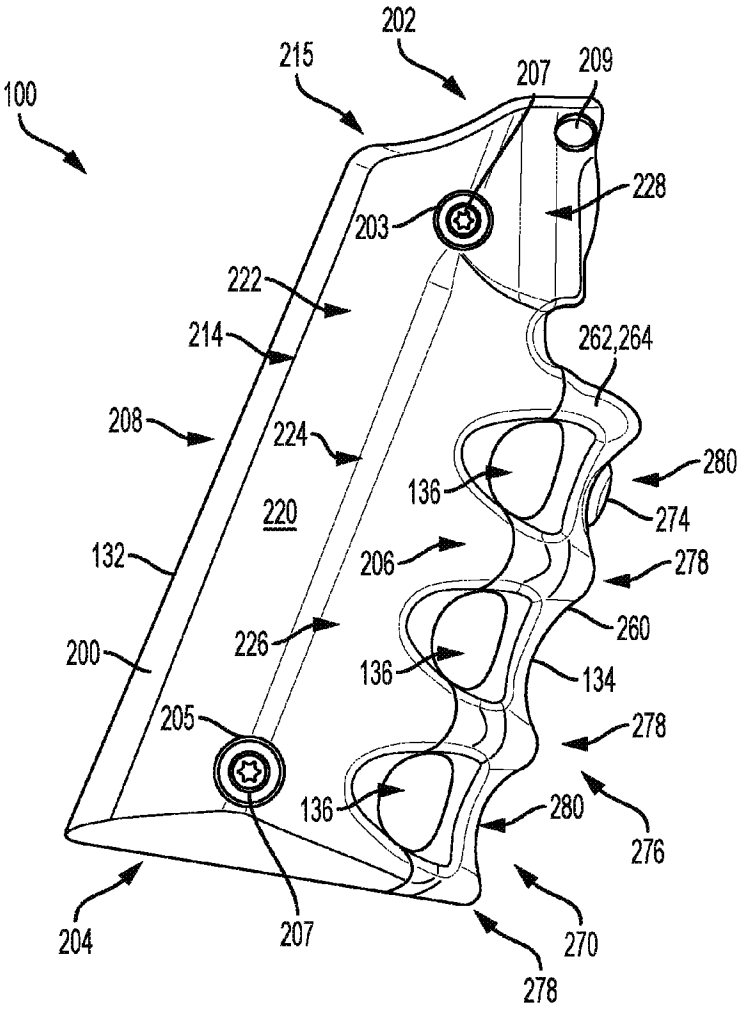
FIG. 3 is a right side elevation view of the grip cover assembly of FIG. 1.
Figure 6:
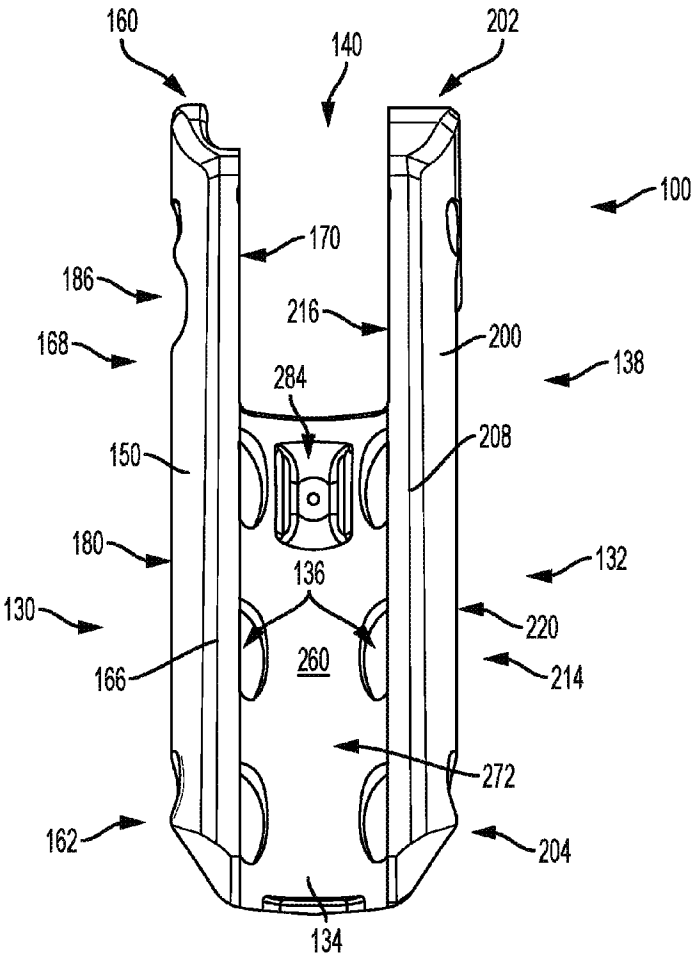
FIG. 6 is a rear elevation view of the grip cover assembly of FIG. 1.
Figure 5:
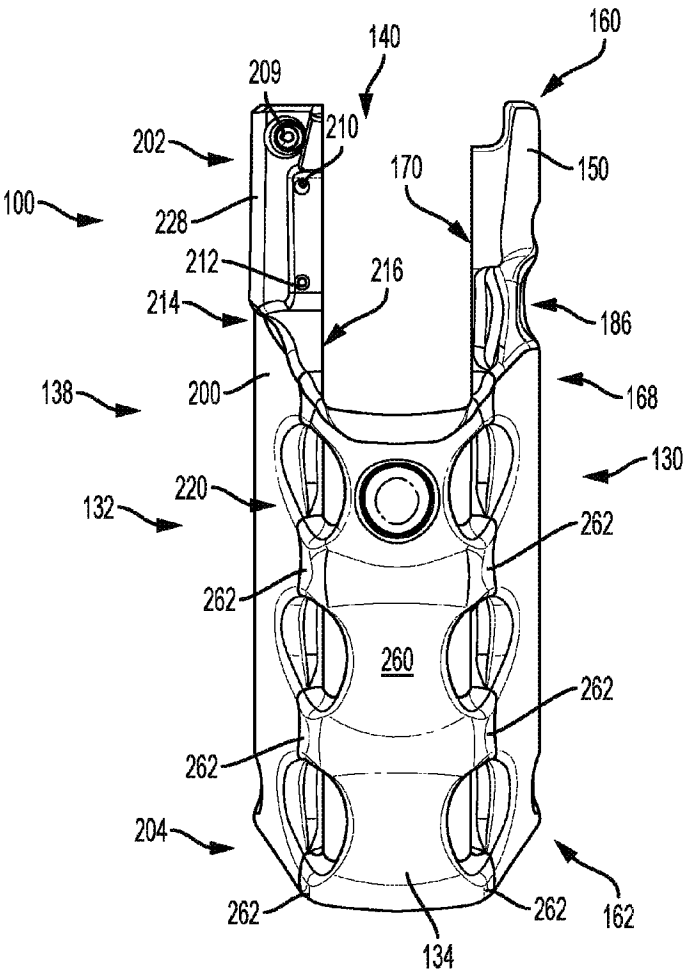
FIG. 5 is a front elevation view of the grip cover assembly of FIG. 1.
Figure 7:
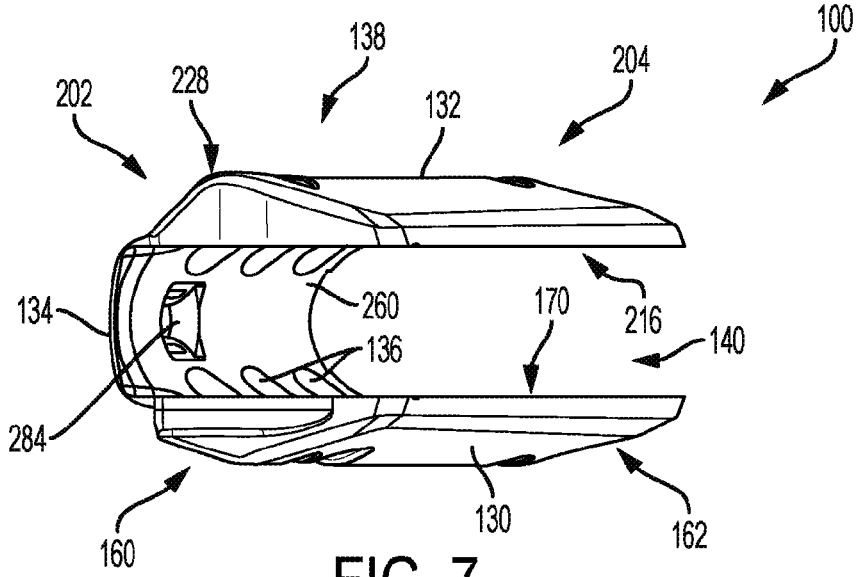
FIG. 7 is a top view of the grip cover assembly of FIG. 1.
Figure 8:
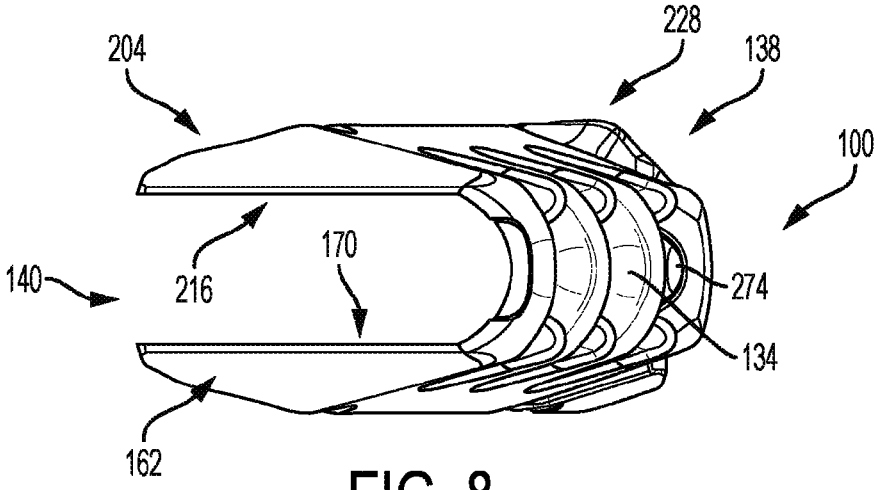
FIG. 8 is a bottom view of the grip cover assembly of FIG. 1.
Figure 9:
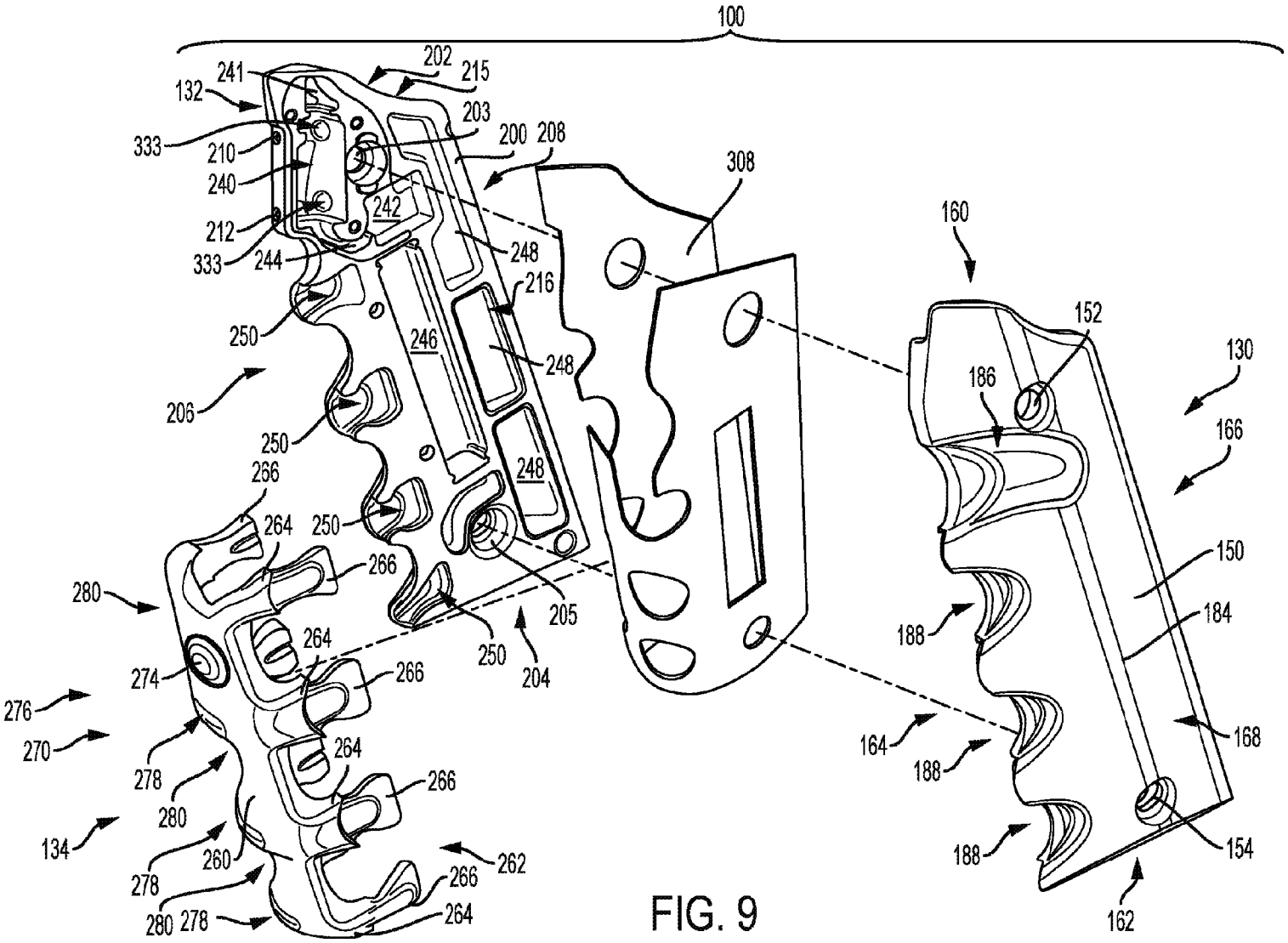
FIG. 9 is an exploded view of the grip cover assembly of FIG. 1, showing relationships between selected components.
Figure 10:
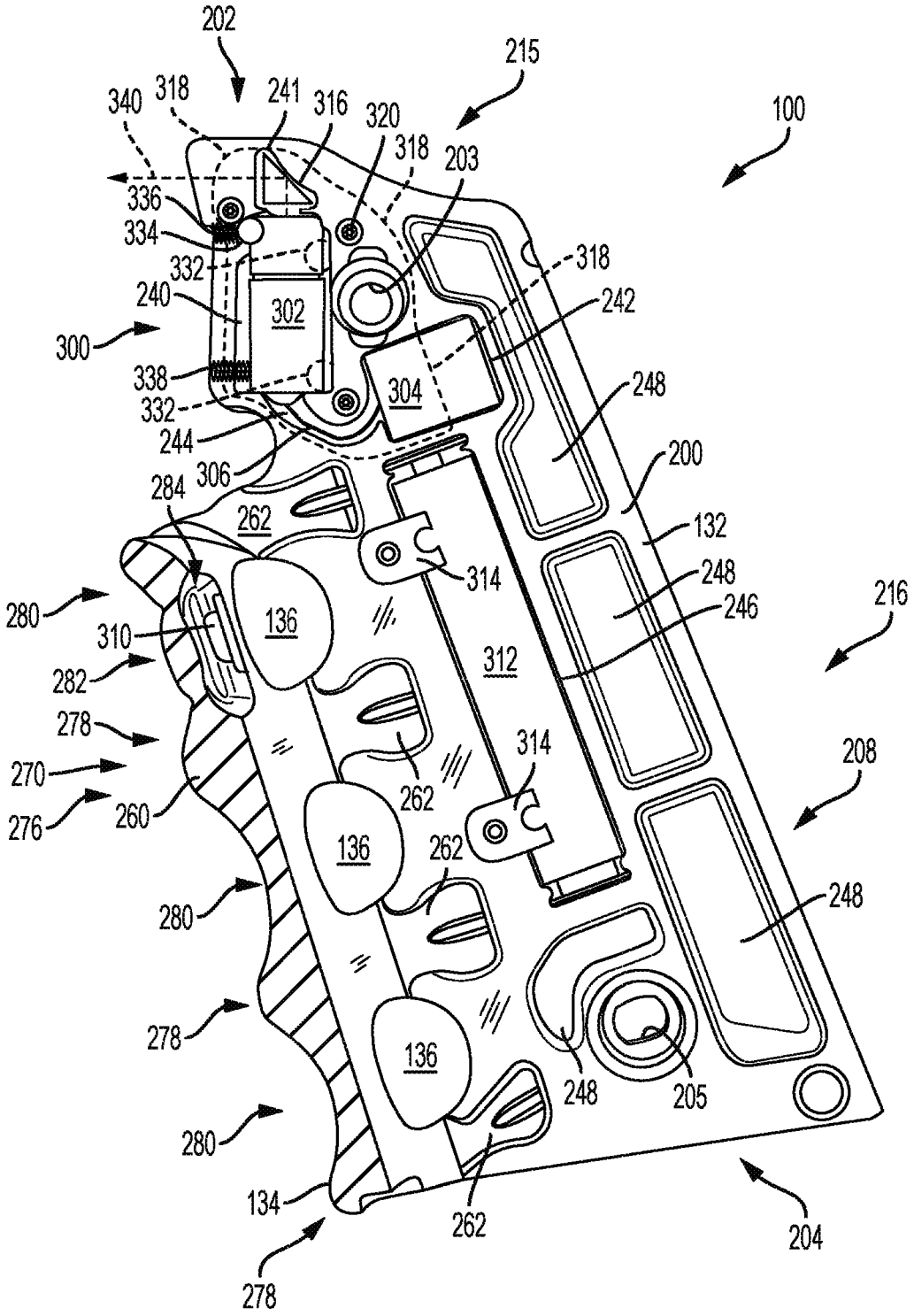
FIG. 10 is a sectional side elevation view of the grip cover assembly of FIG. 1, showing arrangement of selected components of an illustrative laser assembly on an interior surface of one of the grip covers.

FIGS. 1 and 2 are oblique isometric views of grip cover assembly 100 installed on an illustrative handgun 102. FIGS. 3 and 4 are side elevation views of assembly 100. FIGS. 5 and 6 are front and rear views, respectively, of assembly 100. FIGS. 7 and 8 are top and bottom views, respectively, of assembly 100. FIG. 9 is an exploded view of assembly 100, showing a flexible insert of laser assembly 300. Finally, FIG. 10 is a side elevation, sectional view of assembly 100, showing components of laser assembly 300 installed on an interior face of the right grip cover.

Handgun 102 may include any suitable device having a hand grip or pistol grip that will accept add-on or replacement grip covers. In this example, a typical semiautomatic pistol is shown for reference. Handgun 102 has a front end portion 104 (also referred to as the muzzle end) and a rear end portion 106. A barrel 108 extends along the upper side of the handgun, and defines a barrel axis 110. A pair of mechanical sights, specifically a rear sight 112 and a front sight 114 sit atop handgun 102 and may be used to aid in aiming the weapon at a target.

Handgun 102 further includes a grip portion 116, also referred to as a handgrip, for grasping by a user's hand. Grip portion 116 of handgun 102 may include a frame or base portion, to which the grip cover assembly described below is attached. One or more safety switches or levers, such as safety lever 118 may be disposed adjacent to or on grip portion 116 for easy manipulation by the user. A trigger 120 is disposed in front of the grip portion, and is partially surrounded by a trigger guard 122.

As described above, a surface 124 of the handgun is typically metallic, but may also be coated, such as by a ceramic coating. These ceramic coatings may provide protective benefits, as well as being available in a wide range of colors for achieving a custom look for an individual firearm. Additionally or alternatively, surface 124 may be patterned, such as by hydrographic application of camouflage.

Grip cover assembly 100 may include any suitable components configured to collectively provide a wrap-around hand grip cover securely attachable to a handgrip of handgun 102. In this example, assembly 100 includes a first (left) grip cover 130, a second (right) grip cover 132, and a bridge portion 134 configured to connect the two grip covers. When assembled, as shown in FIGS. 1 and 2, covers 130 and 132 in combination with bridge portion 134 form a plurality of gaps or openings 136 exposing surface 124 of a forward portion of grip 116 and contributing to the formation of an ergonomic contour for the user's fingers. Assembly 100 includes an exterior 138 exposed to view and to the ambient environment, and an interior 140 configured to house certain components described below and generally mounted adjacent to the underlying grip 116.

With specific reference to FIGS. 2 and 4-9, left grip cover 130 includes a body 150, also referred to as a panel, having an upper mounting aperture 152 and a lower mounting aperture 154 configured to receive mounting hardware 156 (e.g., screws or bolts), also referred to as one or more fastener(s), to affix the cover to the handgun grip. One or both apertures may be slotted or elongated, such that the cover may be adjusted into slightly different positions and/or orientations relative to the grip.

Body 150 of left grip cover 130 includes a first (top) end portion 160 and a second (bottom) end portion 162, as well as a front edge 164 (also referred to as a front edge portion) and a rear edge 166. An exterior side 168 of body 150 has a surface 180 and a contour 182 configured to enhance the appearance, ergonomics, and/or gripping functionality of assembly 100. For example, contour 182 of body 150 includes a central ridge or peak 184, as well as depressions or recesses in the form of a thumb recess 186 and a plurality of finger recesses 188 along front edge 164. In this example, left grip cover 130 and right grip cover 132 are shown and described in the context of a right-handed grip, because a majority of users will be right handed. For example, when holding handgun 102 with a right hand, the thumb will usually be placed along the left side of the grip. Accordingly, thumb recess 186 is located on left grip cover 130. It should be understood that the covers may alternatively be constructed for a left-handed grip, by reversing the "handedness" features and/or which cover houses the laser assembly and related features described below.

Interior (i.e., inner, or handgrip-facing) side 170 of body 150 may include one or more weight- or material-saving cavities and/or a receiving cavity for a second battery of laser assembly 300. Additionally, receptacles (also referred to as tab receptacles) for receiving appendages of bridge portion 134 are disposed at the interior (i.e., inner, or handgrip-facing) side of front edge 164. Although not visible in the drawings, these cavities and receptacles are substantially as described below with respect to interior side 216 of right grip cover 132.

With specific reference to FIGS. 1, 3, and 5-9, right grip cover 132 includes a body 200, also referred to as a panel, having an upper mounting aperture 203 and a lower mounting aperture 205 configured to receive mounting hardware 207 (e.g., screws or bolts) to affix the cover to the handgun grip. As with the left grip cover, one or both apertures may be slotted or elongated, such that the cover may be adjusted into slightly different positions and/or orientations relative to the grip. Right grip cover 132 further includes a forward-opening laser aperture 209, through which the sighting laser is emitted, and adjustment screw holes 210, 212 passing through a generally front-facing (i.e., forward-facing) surface or edge of the grip cover, for adjusting the position of the laser (described further below).

Body 200 of right grip cover 132 includes a first (top) end portion 202 and a second (bottom) end portion 204, as well as a front edge 206 (also referred to as a front edge portion) and a rear edge 208. An exterior side 214 of body 200 has a surface 220 and a contour 222 configured to enhance the appearance, ergonomics, and/or gripping functionality of assembly 100. For example, contour 222 of body 200 includes a central ridge or peak 224, as well as a plurality of finger recesses 226 along front edge 206. Additionally, because body 200 houses laser assembly 300 on an interior (i.e., inner, or handgrip-facing) side 216, a prominence 228 (also referred to as a bump or bulge) is present in top end portion 202. As mentioned above, the vertical orientation of laser assembly 300 allows prominence 228 to be generally located closer to front edge 206, such that the top rear portion of body 200 can include a cutout 215 or otherwise be shaped to avoid interfering with, e.g., safety lever 118. In addition, prominence 228 is disposed in a natural gap or cavity formed by the user's trigger finger when firing the weapon. In other words, inclusion of the laser assembly results in prominence 228, but does not significantly interfere with the user's grip because the position and orientation of the prominence causes it to fall into a natural curvature or crook of the typically-adjacent finger.

Interior side 216 of body 200 of right grip cover 132 includes a plurality of cavities formed in the otherwise solid body. In top end portion 202, interior side 216 includes a laser assembly cavity 240 in communication with a prism cavity 241 above and a driver board cavity 242 by way of a wiring channel 244 below. A middle portion of body 200 includes a battery cavity 246 configured to receive a battery. Cavity 246 is an elongate recess in the grip cover, configured to conform to an elongate battery. However, other batteries having different shapes may be suitable, in which case battery cavity 246 may have a different shape conforming to the expected battery to be received. The various components to be received in cavities 240, 242, 244, and 246 are described in further detail below.

Similar to the interior side of body 150 of left grip cover 130, body 200 may include one or more weight-saving and/or material-saving cavities 248 on interior side 216, in this example being arranged around the rear and lower periphery of body 150. Also similar to body 150, front edge 206 of interior side 216 includes a plurality (e.g., four) receptacles 250 for receiving appendages of bridge portion 134.

With reference to FIGS. 1-10, bridge portion 134 may include any suitable structure configured to wrap around the front portion of grip 116 of handgun 102 to physically connect left grip cover 130 to right grip cover 132 and provide a comfortable, ergonomic finger rest. As described below, bridge portion 134 may further house and provide an interface for a pushbutton to activate laser assembly 300.

In this example, bridge portion 134 includes a central spine portion 260 oriented generally vertically (i.e., orthogonal to barrel axis 110) and having a plurality of lateral appendages 262 on each lateral side. Appendages 262 protrude from spine portion 260 in a generally rearward direction, such that bridge portion 134 is substantially U-shaped to conform to the front portion of grip 116. Each appendage 262 includes a proximal portion 264 and a distal tab portion 266.

Distal tab portions 266 may have any suitable shape and size to mate (e.g., in a friction fit) with corresponding receptacles 250 on interior sides 170 and 216 of covers 130 and 132, respectively. In this example, there are four tab portions 266 on each side of spine 260. The tab portions are paddle-shape, with upper and lower tab portions being smaller than the two tabs in the middle. Because tab portions 266 are installed between the grip covers and the handgun grip, only proximal portions 264 are externally visible after installation. Because the proximal portions extend from central spine 260, three C-shaped contours are formed on each side, which create openings 136 (i.e., holes) when combined with the undulating front edges (164, 206) of the grip covers.

Central spine portion 260 includes an exterior (forward-facing) face 270 and an interior (rear-facing) face 272. Exterior face 270 of central spine portion 260 may include a pushbutton interface 274 disposed in any suitable location where a user's finger can easily reach and activate an underlying pushbutton of laser assembly 300. In this example, exterior face 270 includes a finger grip contour 276 having four ridges 278 separated by three valleys 280. Pushbutton interface 274 may be disposed in any valley 280, because the user's middle, ring, and small (i.e., pinky) fingers will generally be respectively located in the upper, middle, and lower valleys of finger grip contour 276 when grasping the handgun. In this example, pushbutton interface 274 is centrally disposed in the upper valley 280, where a user's middle finger will typically be placed. Pushbutton interface 274 may include an integrated pushbutton, or (as in this example) may include a resilient button cap for transmitting activation force to an underlying button disposed in a button cavity 284 on interior face 272 (described below).

With specific reference to FIGS. 9-10, an example of laser assembly 300 will now be described. Laser assembly 300 includes a laser 302 (also referred to as a laser emitter) connected to a laser driver board 304 by one or more wires 306. As shown in FIG. 10, laser 302 is housed in laser assembly cavity 240 of right grip cover 132, with laser driver board 304 housed in board cavity 242 and wires 306 passing through wiring channel 244. Laser 302 may include any suitable laser emitting device, such as a class III laser emitter, of any suitable power, such as 5 mW, and any suitable color laser beam (e.g., red or green). Laser driver board 304 may include any suitable laser driver circuit configured to regulate current to laser 302. In some examples, laser driver functionality may be included on a different component, such as the flexible insert described below, in which case a separate board is not necessary. In some examples, a laser may be used that does not require a driver circuit.

A flexible insert 308, best viewed in FIG. 9, wraps around grip 116 and contains a circuit printed thereon, which is configured to electrically connect driver 304 to a pushbutton 310 disposed in cavity 284 and to a power supply in the form of a battery 312 disposed in battery cavity 246. Battery 312 may be held in cavity 246 by one or more clips 314. Flexible insert 308 may include any suitable structure, electrical circuitry, and other devices needed to enable the desired operation of laser assembly 300. For example, one or more circuits (or internal components of the switch itself) may cause pushbutton 310 to act as a latching switch or toggle, such that pressing the pushbutton turns on the laser and the laser remains on when the button is released (i.e., push-to-make/push-to-break). A second press of the pushbutton may then be used to turn the laser off. In some examples, a pattern of button presses could be used. For example, a single press of the button may toggle the laser on, while a pair of rapid-succession presses would be needed to toggle the laser off. In some examples, the pushbutton may be wired as a momentary switch, such that the pushbutton must be held down to keep laser 302 turned on (i.e., emitting). Battery 312 may include any suitable number and type of power storage devices, such as a triple-A battery, a coin battery, an ultra-capacitor, a lithium-ion battery, and/or the like. As described above, battery 312 may include a pair of batteries housed one in each grip cover and connected electrically by insert 308.

As shown in FIG. 10, laser 302 has an upright, upward-firing orientation, generally orthogonal to barrel axis 110. In other words, an emitting end of laser 302 may be pointed generally upward. To redirect a laser beam 340 emitted by laser 302, a reflector 316 is placed above the laser in the path of the beam. In this example, reflector 316 is a reflective triangular prism disposed in prism cavity 241 and configured to reflect the beam ninety degrees to exit grip cover 132 through laser aperture 209. A planar cover 318 may be affixed over laser assembly cavity 240 and prism cavity 241, such as by fastening hardware 320, e.g., to retain the laser and prism therein and/or to facilitate adjustment mechanisms described below. In some examples, insert 308 may instead be affixed to the inner side of right grip cover 132 to carry out functions of cover 318.

With continuing reference to FIGS. 9 and 10, a novel adjustment system for laser assembly 300 will now be described. A laser adjustment assembly is generally indicated at 330 in FIG. 10. Laser adjustment assembly 330 may include any suitable structures and devices configured to selectively adjust the direction of laser beam 340 by adjusting the orientation of laser 302 relative to handgun 102. In this example, laser adjustment assembly 330 includes a compressible member in the form of two cushion balls 332 disposed between laser 302 and grip cover 132 in corresponding seats 333 in laser assembly cavity 240 (see FIG. 9). Assembly 330 further includes a noncompressible member in the form of ball bearing 334 disposed between laser 302 and cover 318 adjacent to an upper end of the laser. A first (upper) set screw 336 extends through threaded hole 210 to interface with ball bearing 334. A second (lower) set screw 338 extends through threaded hole 212 to interface with a lower portion of laser 302.

As described above, holes 210 and 212 pass through a front- or forward-facing edge of the grip cover, such that the holes are oriented generally parallel to barrel axis 110. In some examples, hole 210 and/or hole 212 may pass through a rear-facing edge of the grip cover, while remaining generally parallel to barrel axis 110. This orientation may provide an advantage over known analogous adjustment mechanisms, which are oriented transverse to the barrel axis and therefore add bulk to the grip cover. In other words, the grip cover must be thicker to accommodate these known (transverse) mechanisms. Holes 210 and 212, however, do not require the addition of any thickness to grip cover 132.

Adjustment of the direction of laser beam 340 can be achieved in both the X-Y plane (i.e., left-right, side to side, horizontal, yaw) and the X-Z plane (i.e., up and down, vertical, pitch). To adjust the left-right direction of beam 340, the user can adjust upper set screw 336 to move ball bearing 334 closer to or farther away from rear end portion 106 of handgun 102. Adjusting the set screw inward (i.e., deeper into hole 210) will urge ball bearing 334 in a rearward direction. Ball bearing is trapped on one side by an effectively immovable wall (cover 318) and on the other side by laser 302, which can move slightly against compressible cushion balls 332. Pressing the ball bearing into the side of laser 302 therefore causes the upper end of laser 302 to move in an outboard (e.g., rightward) direction, and the laser beam moves correspondingly. Conversely, adjusting set screw 336 outward (i.e., shallower in hole 210) will remove pressure from laser 302 and allow cushion balls 332 to decompress, thereby urging the upper end of laser 302 in an inboard (e.g., leftward) direction.

To adjust the up-down direction of beam 340, the user can adjust lower set screw 338 to urge the lower end of laser 302 rearward against cushion balls 332 or to back off the force on laser 302 to allow cushion balls 332 to urge the lower end of laser 302 in a forward direction. The upper end of laser 302 will behave in an opposite manner, such that screwing lower set screw 338 deeper into hole 212 will cause laser beam 340 to point in a more downward direction, and unscrewing the set screw will cause laser beam 340 to point in a more upward direction.

Alternatively or additionally, one or more of the attachment/mounting apertures (152, 154, 203, 205) may be elongated or slotted, such that some adjustment of laser assembly 300 may be achieved by adjusting the position of the grip cover(s) on grip 116. In so doing, cavities 240 and 241 will be reoriented, thereby changing the path of laser 340.

Illustrative Manufacturing Method

Figure 11:
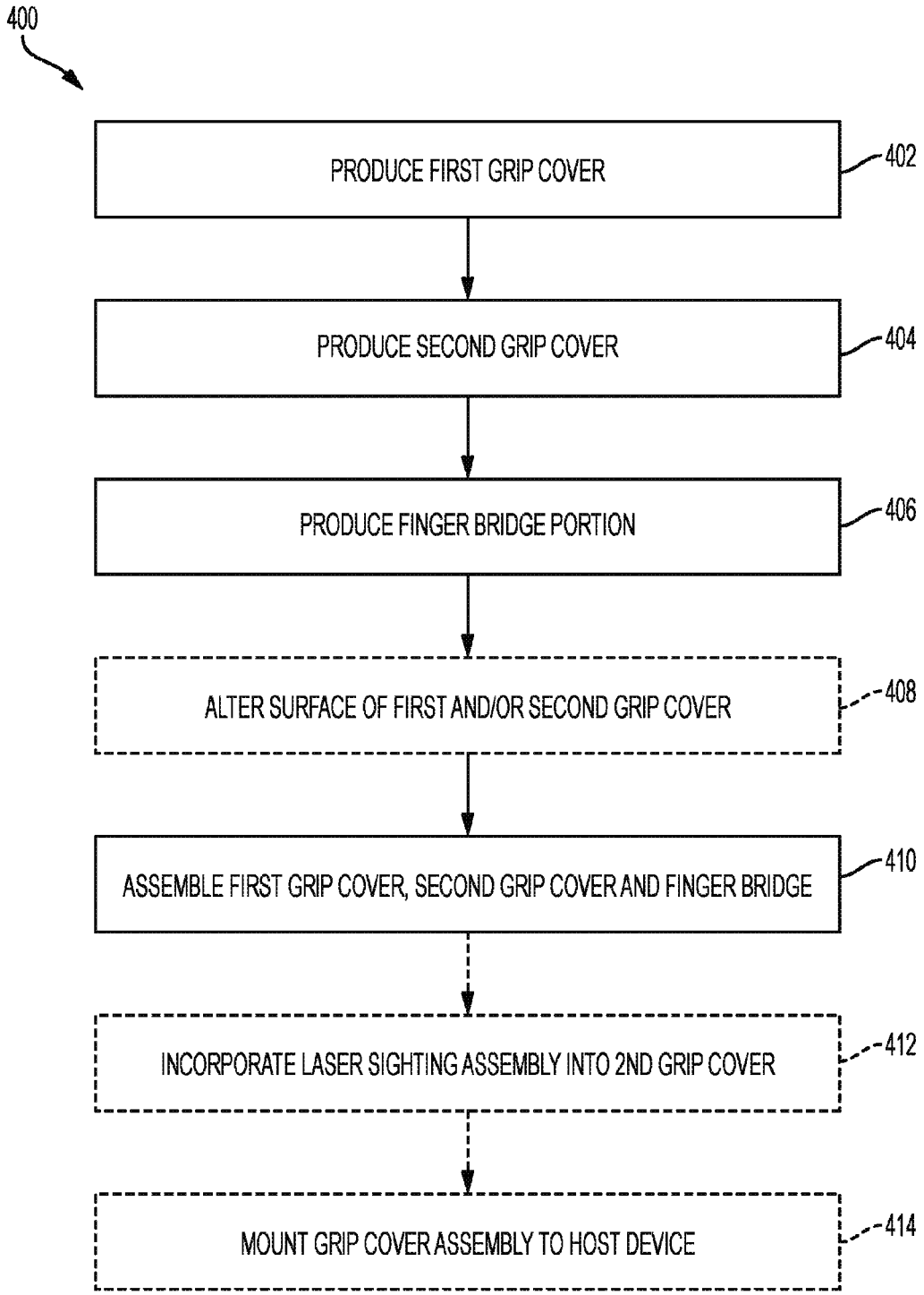
FIG. 11 is a flow chart depicting steps of an illustrative method for manufacturing and installing a grip cover assembly in accordance with aspects of the present disclosure.

This section describes steps of an illustrative method for manufacturing a grip cover assembly including a laser sighting device in accordance with aspects of the present disclosure (e.g., assembly 100); see FIG. 11. Aspects of grip cover assemblies, laser assemblies, and firearms described above may be utilized or involved in the method steps described below. Where appropriate, reference may be made to previously described components and systems that may be used and/or produced in carrying out each step. These references are for illustration, and are not intended to limit the possible ways of carrying out any particular step of the method.

FIG. 11 is a flowchart illustrating steps performed in an illustrative method, and may not recite the complete process or all steps of the method. FIG. 11 depicts multiple steps of a method, generally indicated at 400. Although various steps of method 400 are described below and depicted in FIG. 11, the steps need not necessarily all be performed, and in some cases may be performed in a different order than the order shown.

At step 402, a first grip cover is produced, the first grip cover including a body configured to cover a majority of a first lateral side of a pistol grip or handgrip of a host device. The first grip cover may include an undulating or curvilinear front edge portion having a plurality of ridges and valleys. Producing the first grip cover may include injection molding, die casting, 3D printing, stamping, machining, forging, carving, and/or any combination of these. The first grip cover may comprise any suitable rigid material, such as plastic, aluminum, steel, carbon fiber, wood, bronze, copper, fiberglass, composite materials (e.g., thermoset composite materials, such as G10), and/or the like, or any combination of these. The body of the first grip cover, and/or the entire first grip cover, may be monolithic, composed of only a single material. The body of the first grip cover may include one or more cavities on an inner surface, including a plurality of receptacle cavities formed on the inner surface of the front edge portion. The first grip cover may be configured to conform generally to either a left side or a right side of the host device handgrip.

At step 404, a second grip cover is produced, the second grip cover including a body configured to cover at least a majority of a second lateral side of the pistol grip. The second grip cover may include an undulating or curvilinear front edge portion having a plurality of ridges and valleys mirroring those of the first grip cover. As with the first cover, producing the second grip cover may include injection molding, die casting, 3D printing, stamping, machining, forging, carving, and/or any combination of these. The first grip cover may comprise any suitable rigid material, such as plastic, aluminum, steel, carbon fiber, wood, bronze, copper, fiberglass, composite materials (e.g., thermoset composite materials, such as G10), and/or the like, or any combination of these. The body of the second grip cover and/or the entire second grip cover may be monolithic, consisting of a single material. The body of the second grip cover may include one or more cavities on an inner surface, including a plurality of receptacle cavities formed on the inner surface of the front edge portion. Additional cavities may be formed to receive a laser assembly and/or battery. The second grip cover may include a forward-opening aperture configured for a laser beam generated by the laser assembly to pass therethrough. A laser cavity for housing a laser emitter may be disposed in an upper portion of the second grip cover. The laser cavity may be configured to orient the laser emitter such that the laser is emitted in an upward direction. The second grip cover may be configured to conform generally to either a left side or a right side of the host device pistol grip, whichever is opposite the first grip cover.

At step 406, a finger bridge portion is produced, the bridge portion including a central spine having a plurality of appendages extending from each lateral side of the spine. The appendages extend in a same direction generally orthogonal to the plane of the central spine. The distal end of each appendage may include a tab configured to mate with a corresponding one of the receptacle cavities on the first and second grip covers. Producing the bridge portion may include injection molding, die casting, 3D printing, stamping, machining, and/or any combination of these. The bridge portion may comprise any suitable material configured to provide a comfortable grip for a user's fingers. The bridge portion may comprise a flexible and/or resilient material, such as an elastomer. In some examples, the bridge portion may comprise a natural or synthetic polymer, such as rubber or silicone.

At optional step 408, a surface of the first and/or second grip cover may be altered using an appearance-modifying process. The appearance-modifying process may be incompatible with the bridge portion, e.g., it may damage the bridge portion or otherwise require affirmative protection of the bridge portion. Accordingly, the first and/or second grip cover may be individually painted, etched, printed, hydrodipped, coated, or otherwise patterned. This operation may be performed without the need for methods typically needed to protect portions of the grip assembly from unintended changes, such as masks or friskets (generally referred to as masking). For example, the finger bridge portion, being a separate and independent component, will not be affected by surface alteration of a grip cover prior to assembly. Accordingly, there is no need to mask off the finger bridge portion when altering the grip cover. In examples where the grip cover is monolithic, surface alteration may be made possible and/or more efficient due to working with only a single material.

At step 410, the first grip cover, second grip cover, and finger bridge may be assembled together. For example, the tabs of the appendages of the finger bridge may be mated (e.g., friction fit) with the corresponding receptacles on the forward edges of the first and second grip covers. In some examples, the tabs may be secured to the receptacles, e.g., using an adhesive or epoxy, or other suitable bonding method. When assembled, a plurality of rounded openings are formed on each forward lateral corner of the assembly. These openings are bounded on one side by the generally rounded boundaries created by adjacent pairs of lateral appendages on the finger bridge. On the other side, the openings are bounded by the generally rounded undulations of the front edges of the respective grip covers.

At optional step 412, a laser sighting assembly may be incorporated into the second grip cover, such as by housing one or more laser components in cavities formed on the inner surface of the grip cover body. This step may include installing a laser emitter in a transverse (i.e., non-parallel) orientation relative to the targeting axis of the host device (e.g., barrel axis 110). For example, the laser emitter may be installed such that it points up (or down, or diagonally, etc.) when the host device is in its standard position. A reflector, such as a prism, may be installed adjacent the laser emitter, such that the reflector redirects an emitted laser beam along the intended aiming path, through the forward-opening laser aperture in the second grip cover.

At optional step 414, the grip cover assembly may be mounted to the pistol grip of the host device, such that the first and second grip covers are disposed on opposing lateral sides of the pistol grip, and portions of the surface of the pistol grip are visible through the openings formed between the finger bridge portion and the grip covers. For example, the assembly may be slid onto the front of the pistol grip in a rearward direction, upward from the bottom of the pistol grip, or wrapped around the front of the pistol grip, such that the first grip cover is adjacent to a first lateral side face of the pistol grip, the second grip cover is adjacent to a second lateral side face of the pistol grip, and the finger bridge is adjacent the forward-facing surface of the pistol grip. The first and second grip covers may then be secured to the pistol grip, such as using fastening hardware (e.g., screws).

Illustrative Laser Adjustment Method

Figure 12:
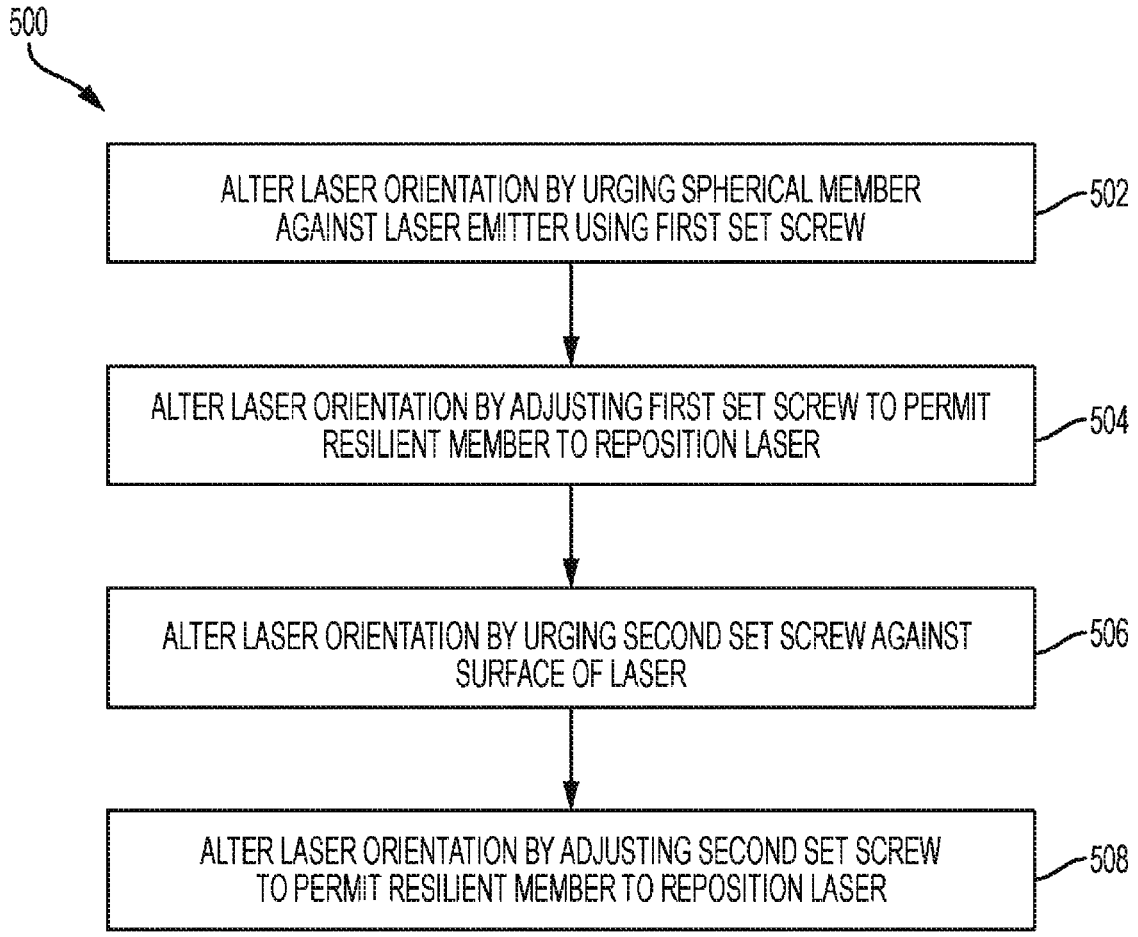
FIG. 12 is a flow chart depicting steps of an illustrative method for adjusting a laser sighting device integrated into a grip cover assembly in accordance with aspects of the present disclosure.

This section describes steps of an illustrative method for adjusting a laser sighting device in accordance with aspects of the present disclosure; see FIG. 12. Aspects of grip cover assemblies and laser assemblies described above may be utilized in the method steps described below. Where appropriate, reference may be made to previously described components and systems that may be used in carrying out each step. These references are for illustration, and are not intended to limit the possible ways of carrying out any particular step of the method.

FIG. 12 is a flowchart illustrating steps performed in an illustrative method, and may not recite the complete process or all steps of the method. FIG. 12 depicts multiple steps of a method, generally indicated at 500, which may be performed in conjunction with grip cover assemblies having laser sighting devices according to aspects of the present disclosure. Although various steps of method 500 are described below and depicted in FIG. 12, the steps need not necessarily all be performed, and in some cases may be performed in a different order than the order shown.

At step 502, the direction, with respect to a first plane, of a beam emitted by an emitter of a laser mounted vertically in a grip cover of a grip cover assembly may be altered. This may be performed by adjusting a first set screw (e.g., set screw 336) to urge a spherical member (e.g., ball bearing 334) against a first surface of a top portion of the laser emitter, the spherical member being trapped between a wall surface (e.g., of cover 318) and the first surface of the laser emitter, such that the top portion of the laser emitter is forced away from the wall by a wedging action of the spherical member. The first set screw may be oriented substantially horizontally. The first set screw may be substantially parallel to a firing axis of the host firearm. The first set screw may be accessible from a forward-facing edge of the grip cover.

At step 504, the beam direction with respect to the first plane may again be adjusted by adjusting the first set screw to allow the spherical member and top portion of the laser emitter to be urged toward the wall by a resilient member disposed on an opposing second surface of the laser emitter (e.g., cushion ball(s) 332).

At step 506, the beam direction with respect to a second plane orthogonal to the first plane may be adjusted by urging a second set screw (e.g., set screw 338) against a third surface of the laser emitter to tilt the laser emitter in a first direction. In some examples, the second set screw may be oriented substantially horizontally. In some examples, the second set screw may be accessible from a forward-facing edge of the grip cover (e.g., the same edge as the first set screw). In some examples, the second set screw may be substantially parallel to the firing axis of the host firearm.

At step 508, the beam direction with respect to the second plane may be adjusted by adjusting the second set screw away from the third surface of the laser emitter, such that the laser emitter is urged in a second direction by the resilient member.

ADDITIONAL EXAMPLES AND ILLUSTRATIVE COMBINATIONS

This section describes additional aspects and features of grip cover assemblies and related methods, presented without limitation as a series of paragraphs, some or all of which may be alphanumerically designated for clarity and efficiency. Each of these paragraphs can be combined with one or more other paragraphs, and/or with disclosure from elsewhere in this application, in any suitable manner. Some of the paragraphs below expressly refer to and further limit other paragraphs, providing without limitation examples of some of the suitable combinations.

A0. A grip cover assembly for a firearm, the grip cover assembly comprising:

a first grip cover attachable to a first side of a handgrip of a firearm, a first front edge portion of the first grip cover configured to be adjacent a front of the handgrip when the first grip cover is attached to the handgrip;

a second grip cover attachable to a second side of the handgrip, the second grip cover housing a laser assembly configured to selectively project a laser beam through a laser aperture in the second grip cover, a second front edge portion of the second grip cover configured to be adjacent the front of the handgrip when the second grip cover is attached to the handgrip; and a bridge portion coupling the first front edge portion to the second front edge portion and configured to wrap around the front of the handgrip, the bridge portion including a central spine portion having a first plurality of spaced-apart appendages extending from a first lateral side of the central spine portion to mate with the first front edge portion of the first grip cover, and a second plurality of spaced-apart appendages extending from a second lateral side of the central spine portion to mate with the second front edge portion of the second grip cover;

wherein one or more first openings are formed between the central spine portion of the bridge portion and the first front edge portion of the first grip cover, and one or more second openings are formed between the central spine portion of the bridge portion and the second front edge portion of the second grip cover, such that the first and second openings are configured to expose the handgrip of the firearm.

A1. The assembly of A0, wherein a first body of the first grip cover is monolithic, and a second body of the second grip cover is monolithic.

A2. The assembly of A0 or A1, wherein the first body and the second body comprise a first material, and the bridge portion comprises a second material.

A3. The assembly of A2, wherein the first body and the second body consist of a first material, and the bridge portion consists of a second material.

A4. The assembly of A2, wherein the second material is an elastomer.

A5. The assembly of any of paragraphs A0 through A4, wherein the one or more first openings comprise three first openings, and the one or more second openings comprise three corresponding second openings, such that the first and second openings are configured to form three finger rests for three respective fingers of a user.

A6. The assembly of any of paragraphs A0 through A5, wherein each of the one or more first openings is bounded by the central spine portion of the bridge portion, the first front edge portion of the first grip cover, and a respective two appendages of the first plurality of appendages.

A7. The assembly of any of paragraphs A0 through A6, wherein each appendage of the first plurality of appendages includes a tab portion at a distal end, each tab portion configured to mate in a friction fit with a corresponding respective tab receptacle on the front edge portion of the first grip cover.

A8. The assembly of A7, wherein each tab receptacle is disposed on a handgrip-facing side of the first front edge portion of the first grip cover.

A9. The assembly of A7, wherein each tab portion is affixed to each respective tab receptacle by an adhesive.

A10. The assembly of any of paragraphs A0 through A9, wherein the laser assembly comprises a laser emitter housed in a substantially vertical orientation in the second grip cover, and a reflector disposed adjacent an emitting end of the laser emitter, such that the reflector is configured to redirect the laser beam, projected by the laser emitter, to exit the laser aperture of the second grip cover.

A11. The assembly of A10, wherein the reflector comprises a reflective prism.

A12. The assembly of A10, wherein the laser emitter is oriented to emit the laser beam in an upward direction.

A13. The assembly of A10, the laser assembly further comprising at least one adjustment screw having a first end accessible at a forward-facing edge of the second grip cover and passing through the second grip cover such that a second end of the at least one adjustment screw is disposed adjacent the laser emitter.

B0. A method of manufacturing a grip cover assembly for a firearm, the method comprising:

producing a first grip cover including a monolithic first body configured to conform to a first lateral face of a handgrip of a host device, the first body further comprising an undulating first front edge portion including a first inner face having a plurality of first receptacles formed therein;

producing a second grip cover including a monolithic second body configured to conform to a second lateral face of the handgrip of the host device, the second body further comprising one or more cavities configured to house a laser assembly, and an undulating second front edge portion including a second inner face having a plurality of second receptacles formed therein;

producing a bridge portion comprising a central spine portion having a plurality of first appendages extending from a first lateral side of the spine portion and a plurality of second appendages extending from a second lateral side of the spine portion, the bridge portion comprising a resilient material;

attaching the bridge portion to the first grip cover by mating each of the first appendages of the bridge portion to a respective one of the first receptacles of the first grip cover; and attaching the bridge portion to the second grip cover by mating each of the second appendages of the bridge portion to a respective one of the second receptacles of the second grip cover;

wherein one or more first openings are formed between the central spine portion of the bridge portion and the first front edge portion of the first grip cover, and one or more second openings are formed between the central spine portion of the bridge portion and the second front edge portion of the second grip cover.

B1. The method of B0, wherein producing the first grip cover comprises die casting the first body.

B2. The method of B0 or B1, further including:

modifying an appearance of a surface of the first grip cover using an appearance-modifying process, before attaching the bridge portion to the first grip cover.

B3. The method of B2, wherein modifying the appearance of the surface of the first grip cover is performed without masking any portion of the grip cover assembly.

B4. The method of B2, wherein the appearance-modifying process comprises hydrodipping.

B5. The method of B2, wherein the bridge portion is incompatible with the appearance-modifying process.

B6. The method of any of paragraphs B0 through B5, wherein the bridge portion comprises an elastomer.

B7. The method of any of paragraphs B0 through B6, wherein the attaching the bridge portion to the first grip cover comprises mating a respective distal tab portion of each of the first appendages of the bridge portion to a respective one of the first receptacles of the first grip cover in a friction fit.

B8. The method of any of paragraphs B0 through B7, wherein the laser assembly includes a laser emitter and a reflector, the method further comprising installing the laser emitter in one of the cavities of the second body, in an orientation that is transverse to a targeting axis of the host device, and installing the reflector adjacent an emitting end of the laser emitter.

B9. The method of B8, wherein the one of the cavities in which the laser emitter is installed is disposed in a top end portion of the second body.

B10. The method of B8, wherein the orientation of the laser emitter is substantially vertical.

B11. The method of any of paragraphs B0 through B10, further comprising:

placing the grip cover assembly, comprising the first grip cover and the second grip cover each attached to the bridge portion, onto a handgrip of a host device;

attaching the first grip cover to a first lateral face of the handgrip using one or more first fasteners;

wrapping the bridge portion around a front side of the handgrip; and attaching the second grip cover to a second lateral face of the handgrip using one or more second fasteners;

wherein the handgrip is visible through the first openings and the second openings.

C0. A laser grip cover for a firearm having a handgrip, the laser grip cover comprising:

a monolithic first grip cover panel including a first front edge portion having a plurality of first tab receptacles formed therein;

a monolithic second grip cover panel including a first cavity housing a substantially vertical laser emitter and a reflector disposed at an emitter end of the laser emitter, the first cavity disposed in a top end portion of the second grip cover panel, and a second front edge portion having a plurality of second tab receptacles formed therein; and a bridge portion having a plurality of first tabs mated with respective ones of the first tab receptacles and a plurality of second tabs mated with respective ones of the second tab receptacles, coupling the first front edge portion of the first grip cover panel to the second front edge portion of the second grip cover panel, and forming a plurality of first openings between the bridge portion and the first front edge portion and a plurality of second openings between the bridge portion and the second front edge portion.

C1. The laser grip cover of C0, wherein the first grip cover panel and the second grip cover panel comprise a first material, and the bridge portion comprises a second material.

C2. The laser grip cover of C1, wherein the first grip cover panel and the second grip cover panel consist of a first material, and the bridge portion consists of a second material.

C3. The laser grip cover of C1, wherein the second material is an elastomer.

C4. The laser grip cover of any of paragraphs C0 through C3, wherein the plurality of first openings comprises three first openings, and the plurality of second openings comprises three corresponding second openings, such that the first and second openings comprise three finger rests for three respective fingers of a user.

C5. The laser grip cover of any of paragraphs C0 through C4, wherein each of the first tab receptacles is disposed on a handgrip-facing side of the first front edge portion.

C6. The laser grip cover of any of paragraphs C0 through C5, wherein each respective tab portion is affixed to each respective tab receptacle by an adhesive.

C7. The laser grip cover of any of paragraphs C0 through C6, wherein the reflector is configured to redirect a laser beam projected by the laser emitter to exit through a laser aperture in a front-facing edge of the second grip cover panel.

C8. The laser grip cover of C7, wherein the laser emitter is oriented to emit the laser beam in an upward direction.

C9. The laser grip cover of any of paragraphs C0 through C8, wherein the reflector comprises a reflective prism.

C10. The laser grip cover of any of paragraphs C0 through C9, further comprising at least one adjustment screw having a first end accessible at a forward-facing edge of the second grip cover panel and passing through the second grip cover panel such that a second end of the at least one adjustment screw is disposed adjacent the laser emitter.

Advantages, Features, Benefits

The different embodiments and examples of the grip cover assemblies, and related methods, described herein provide several advantages over known solutions. For example, illustrative embodiments and examples described herein allow selective appearance modification of side panels, without a need for masking or other protective measures with respect to more fragile portions of the assembly. For example, grip cover panels may be hydrodipped or painted without masking an elastomer finger bridge portion, because the modular panels and finger bridge are assembled separately. In some examples, the panels and bridge portion may be disassembled and reassembled nondestructively, such as by using the friction-fit tab and receptacle system described in examples above.

Additionally, and among other benefits, illustrative embodiments and examples described herein place the laser emitter and its associated bulk in an orientation and position that does not interfere with the user's grip or operation of the firearm. For example, the vertically-oriented, high-mounted laser shown in the drawings will fit into a natural cavity formed by a user's trigger finger when holding the firearm.

Additionally, and among other benefits, illustrative embodiments and examples described herein include holes or openings formed naturally between the assembled components (i.e., without forming holes through the individual components), which expose an underlying firearm surface and contribute to an ergonomic finger rest for each of the user's lower fingers.

Additionally, and among other benefits, illustrative embodiments and examples described herein include a laser adjustment mechanism that does not increase the lateral thickness of the grip covers, e.g., because the adjustment screws are horizontally oriented and accessible through a front edge of the cover.

No known system or device can perform these functions. However, not all embodiments and examples described herein provide the same advantages or the same degree of advantage.

CONCLUSION

The disclosure set forth above may encompass multiple distinct examples with independent utility. Although each of these has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

What is claimed is:

1. A grip cover assembly for a firearm, the grip cover assembly comprising:

a first grip cover attachable to a first side of a handgrip of a firearm, a first front edge portion of the first grip cover configured to be adjacent a front of the handgrip when the first grip cover is attached to the handgrip;

a second grip cover attachable to a second side of the handgrip, the second grip cover housing a laser assembly configured to selectively project a laser beam through a laser aperture in the second grip cover, a second front edge portion of the second grip cover configured to be adjacent the front of the handgrip when the second grip cover is attached to the handgrip; and a bridge portion coupling the first front edge portion to the second front edge portion and configured to wrap around the front of the handgrip, the bridge portion including a central spine portion having a first plurality of spaced-apart appendages extending from a first lateral side of the central spine portion to mate with the first front edge portion of the first grip cover, and a second plurality of spaced-apart appendages extending from a second lateral side of the central spine portion to mate with the second front edge portion of the second grip cover;

wherein one or more first openings are formed between the central spine portion of the bridge portion and the first front edge portion of the first grip cover, and one or more second openings are formed between the central spine portion of the bridge portion and the second front edge portion of the second grip cover, such that the first and second openings are configured to expose the handgrip of the firearm.

2. The assembly of claim 1, wherein the first body and the second body consist of a first material, and the bridge portion comprises a second material.

3. The assembly of claim 2, wherein the second material is an elastomer.

4. The assembly of claim 1, wherein the one or more first openings comprise three first openings, and the one or more second openings comprise three corresponding second openings, such that the first and second openings form three finger rests for three respective fingers of a user.

5. The assembly of claim 1, wherein each of the one or more first openings is bounded by the central spine portion of the bridge portion, the first front edge portion of the first grip cover, and a respective two appendages of the first plurality of appendages.

6. The assembly of claim 1, wherein each appendage of the first plurality of appendages includes a tab portion at a distal end, each tab portion configured to mate in a friction fit with a corresponding respective tab receptacle on the front edge portion of the first grip cover.

7. The assembly of claim 1, wherein the laser assembly comprises a laser emitter housed in a substantially vertical orientation in the second grip cover, and a reflector disposed adjacent an emitting end of the laser emitter, such that the reflector is configured to redirect the laser beam, projected by the laser emitter, to exit the laser aperture of the second grip cover.

8. The assembly of claim 7, the laser assembly further comprising at least one adjustment screw having a first end accessible at a forward-facing edge of the second grip cover and passing through the second grip cover such that a second end of the at least one adjustment screw is disposed adjacent the laser emitter.

9. A laser grip cover for a firearm having a handgrip, the laser grip cover comprising:

a monolithic first grip cover panel including a first front edge portion having a plurality of first tab receptacles formed therein;

a monolithic second grip cover panel including a first cavity housing a substantially vertical laser emitter and a reflector disposed at an emitter end of the laser emitter, the first cavity disposed in a top end portion of the second grip cover panel, and a second front edge portion having a plurality of second tab receptacles formed therein; and a bridge portion having a plurality of first tabs mated with respective ones of the first tab receptacles and a plurality of second tabs mated with respective ones of the second tab receptacles, coupling the first front edge portion of the first grip cover panel to the second front edge portion of the second grip cover panel, and forming a plurality of first openings between the bridge portion and the first front edge portion and a plurality of second openings between the bridge portion and the second front edge portion.

10. The laser grip cover of claim 9, wherein the first grip cover panel and the second grip cover panel comprise a first material, and the bridge portion comprises a second material.

11. The laser grip cover of claim 9, wherein the plurality of first openings comprises three first openings, and the plurality of second openings comprises three corresponding second openings, such that the first and second openings comprise three finger rests for three respective fingers of a user.

12. The laser grip cover of claim 9, wherein each of the first tab receptacles is disposed on a handgrip-facing side of the first front edge portion.

13. The laser grip cover of claim 9, wherein the reflector is configured to redirect a laser beam projected by the laser emitter to exit through a laser aperture in a front-facing edge of the second grip cover panel.

14. The laser grip cover of claim 9, further comprising at least one adjustment screw having a first end accessible at a forward-facing edge of the second grip cover panel and passing through the second grip cover panel such that a second end of the at least one adjustment screw is disposed adjacent the laser emitter.

15. A method of manufacturing a grip cover assembly for a firearm, the method comprising:

producing a first grip cover including a monolithic first body configured to conform to a first lateral face of a handgrip of a host device, the first body further comprising an undulating first front edge portion including a first inner face having a plurality of first receptacles formed therein;

producing a second grip cover including a monolithic second body configured to conform to a second lateral face of the handgrip of the host device, the second body further comprising one or more cavities configured to house a laser assembly, and an undulating second front edge portion including a second inner face having a plurality of second receptacles formed therein;

producing a bridge portion comprising a central spine portion having a plurality of first appendages extending from a first lateral side of the spine portion and a plurality of second appendages extending from a second lateral side of the spine portion, the bridge portion comprising a resilient material;

attaching the bridge portion to the first grip cover by mating each of the first appendages of the bridge portion to a respective one of the first receptacles of the first grip cover; and attaching the bridge portion to the second grip cover by mating each of the second appendages of the bridge portion to a respective one of the second receptacles of the second grip cover;

wherein one or more first openings are formed between the central spine portion of the bridge portion and the first front edge portion of the first grip cover, and one or more second openings are formed between the central spine portion of the bridge portion and the second front edge portion of the second grip cover.

16. The method of claim 15, further including:

modifying an appearance of a surface of the first grip cover using an appearance-modifying process, before attaching the bridge portion to the first grip cover.

17. The method of claim 16, wherein modifying the appearance of the surface of the first grip cover is performed without masking any portion of the grip cover assembly.

18. The method of claim 15, wherein the attaching the bridge portion to the first grip cover comprises mating a respective distal tab portion of each of the first appendages of the bridge portion to a respective one of the first receptacles of the first grip cover in a friction fit.

19. The method of claim 15, wherein the laser assembly includes a laser emitter and a reflector, the method further comprising installing the laser emitter in one of the cavities of the second body, in an orientation that is transverse to a targeting axis of the host device, and installing the reflector adjacent an emitting end of the laser emitter.

20. The method of claim 15, further comprising:

placing the grip cover assembly, comprising the first grip cover and the second grip cover each attached to the bridge portion, onto a handgrip of a host device;

attaching the first grip cover to a first lateral face of the handgrip using one or more first fasteners;

wrapping the bridge portion around a front side of the handgrip; and attaching the second grip cover to a second lateral face of the handgrip using one or more second fasteners;

wherein the handgrip is visible through the first openings and the second openings.

* * * * *